US007913820B2

(12) United States Patent
Sakurai

(10) Patent No.: US 7,913,820 B2
(45) Date of Patent: Mar. 29, 2011

(54) CONTROL SYSTEM FOR ELEVATOR

(75) Inventor: Susumu Sakurai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 539 days.

(21) Appl. No.: 12/066,456

(22) PCT Filed: Dec. 7, 2005

(86) PCT No.: PCT/JP2005/022462

§ 371 (c)(1),
(2), (4) Date: Mar. 11, 2008

(87) PCT Pub. No.: WO2007/066390

PCT Pub. Date: Jun. 14, 2007

(65) Prior Publication Data

US 2008/0196979 A1 Aug. 21, 2008

(51) Int. Cl.
*B66B 1/34* (2006.01)

(52) U.S. Cl. ..... 187/396; 187/387; 187/384

(58) Field of Classification Search ..... 187/247, 187/380–389, 391–396
See application file for complete search history.

(56) References Cited

U.S. PATENT DOCUMENTS

| | | | | |
|---|---|---|---|---|
| 5,411,118 | A * | 5/1995 | Thangavelu et al. | 187/392 |
| 6,397,976 | B1 * | 6/2002 | Hale et al. | 187/392 |
| 6,945,365 | B2 * | 9/2005 | Matela | 187/382 |
| 7,328,775 | B2 * | 2/2008 | Zaharia et al. | 187/396 |
| 7,717,238 | B2 * | 5/2010 | Hamaji et al. | 187/396 |
| 2009/0120726 | A1 * | 5/2009 | Stanley et al. | 187/382 |

FOREIGN PATENT DOCUMENTS

| | | |
|---|---|---|
| JP | 55 82270 | 6/1980 |
| JP | 4 226293 | 8/1992 |
| JP | 4 358682 | 12/1992 |
| JP | 11 21031 | 1/1999 |
| JP | 2000 16729 | 1/2000 |
| JP | 3040524 | 3/2000 |
| JP | 2002 220177 | 8/2002 |

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

A control system for elevators controls the operations of a plurality of elevator apparatuses. The elevator apparatuses have cars and elevator doorways provided at each landing floor. The control system for the elevators is equipped with a landing call registration device, a landing call automatic registration portion, a response selection portion, a passenger traveling time period calculation portion, and an opening/closing control portion. The landing call registration device is provided at the landing floor to be operable at the landing floor. The landing call automatic registration portion sets as a car call floor the landing floor whose landing call registration device is operated, and makes a car call registration for stopping one of the cars at the car call floor. The response selection portion selects as a selected elevator that one of the elevator apparatuses which responds to the car call registration, based on information from the elevator apparatuses and information from the landing call automatic registration portion. The passenger traveling time period calculation portion sets as a selected doorway that one of the elevator doorways of the selected elevator, which is provided at the car call floor, based on information from the response selection portion, and calculates a passenger traveling time period corresponding to the selected doorway. The opening/closing control portion controls opening/closing operations of the selected doorway based on information from the selected elevator and information from the passenger traveling time period calculation portion.

7 Claims, 10 Drawing Sheets

CONTROL SYSTEM FOR ELEVATOR

TECHNICAL FIELD

The present invention relates to a control system for elevators for controlling operations of elevator apparatuses.

BACKGROUND ART

Conventionally, there has been proposed an elevator group control device for supervising traveling of a plurality of elevator apparatuses as a group. In a building provided with this conventional elevator group control device, elevator doorways corresponding to each of the elevator apparatuses are provided at each single floor. A call registration command device, which is operated by passengers to call cars, is provided at that floor. When the call registration command device is operated, the allocation of those of the cars which are to be moved to that floor is carried out.

The allocation of the cars is carried out by comparing time periods required until the arrival of the cars at that floor with time periods required until the arrival of passengers at the elevator doorways. In this case, when the time period required until the arrival of a certain one of the cars at that floor is shorter than the time period required until the arrival of a passenger at a corresponding one of the elevator doorways, this elevator doorway is excluded from targets for allocation. Thus, that one of the cars which arrives after the arrival of the passenger at the elevator doorway can be allocated, so the passenger is prevented from missing that car (see Patent Document 1).

Patent Document 1: U.S. Pat. No. 3,040,524

DISCLOSURE OF THE INVENTION

Problem to be Solved by the Invention

However, in the conventional elevator group control device, those of the cars which can arrive before a passenger arrives at each of the elevator doorways are excluded from allocated objects. Therefore, even when, for example, one of the cars is stopped at that floor and the other cars are located far from that floor and take a long time to arrive at that floor, those cars located far from that floor are allocated. As a result, the passenger can arrive at each of the elevator doorways before those cars arrive at that floor. However, the passenger must wait for the arrival of those cars in front of each of the elevator doorways for a long time.

The present invention has been made to solve the above-mentioned problem, and it is therefore an object of the present invention to provide a control system for elevators which makes it possible to shorten the waiting time periods of passengers and prevent the passengers from missing cars.

Means for Solving the Problem

A control system for elevators according to the present invention controls operations of a plurality of elevator apparatuses, which have cars that can stop at a common landing floor and elevator doorways provided at the landing floor for allowing passengers to get on/off the cars stopped at the landing floor from/to the landing floor. The control system includes: a landing call registration device provided at the landing floor to be operable at the landing floor; a landing call automatic registration portion for setting as a car call floor the landing floor where the landing call registration device is operated, and making a car call registration for stopping any one of the cars at the car call floor; a response selection portion for selecting as a selected elevator that one of the elevator apparatuses which responds to the car call registration, based on information from the elevator apparatuses and information from the landing call automatic registration portion; a passenger traveling time period calculation portion for setting as a selected doorway that one of the elevator doorways of the selected elevator, which is provided at the car call floor, based on information from the response selection portion, and calculating a passenger traveling time period required for traveling of passengers from the landing call registration device to the selected doorway; and an opening/closing control portion for controlling opening/closing operations of the selected doorway based on information from the selected elevator and information from the passenger traveling time period calculation portion.

BEST MODES FOR CARRYING OUT THE INVENTION

Preferred embodiments of the present invention will be described hereinafter with reference to the drawings.

Embodiment 1

Figure 1:
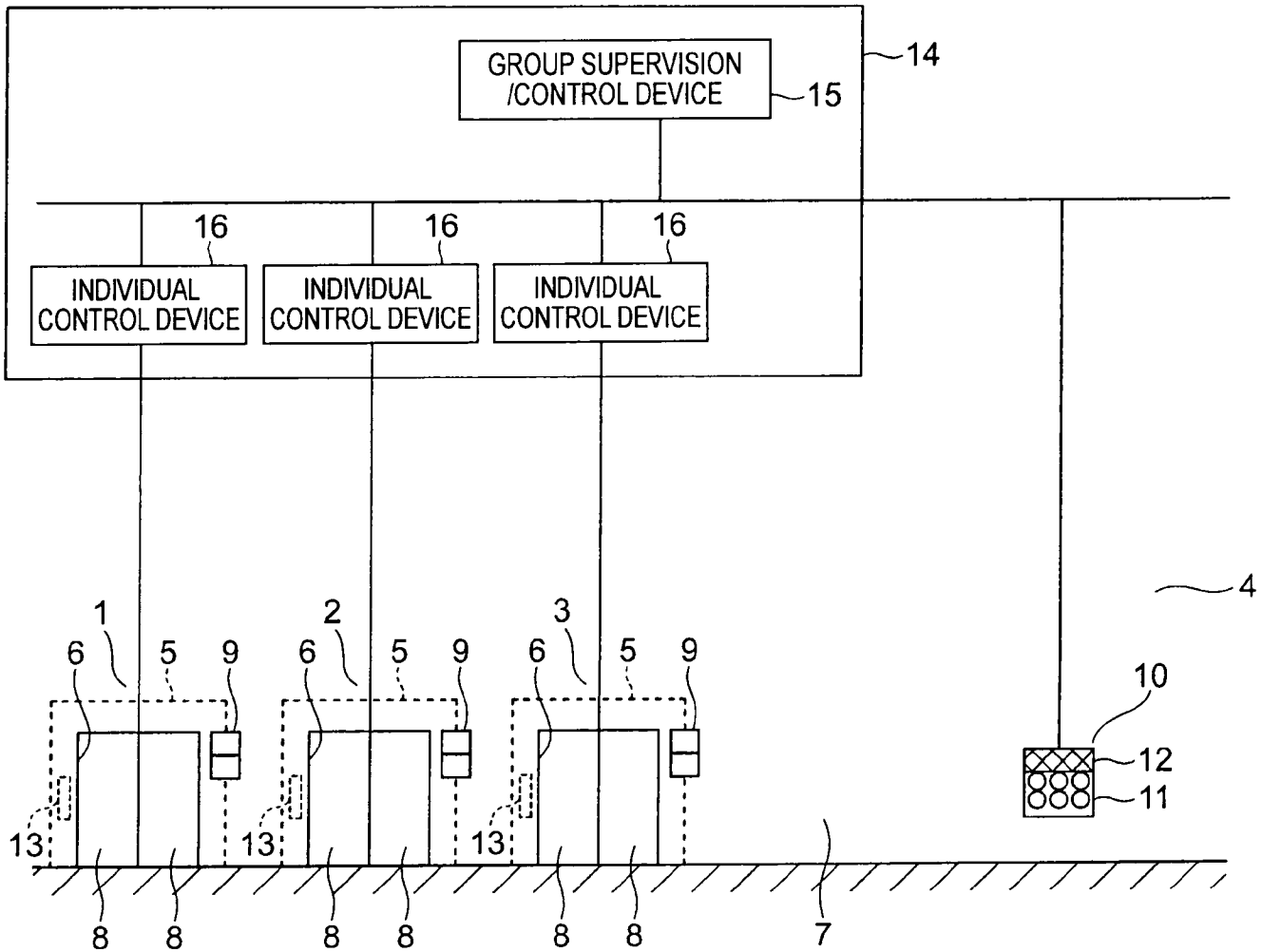
FIG. 1 is a schematic diagram showing a control system for elevators according to Embodiment 1 of the present invention.

FIG. 1 is a schematic diagram showing a control system for elevators according to Embodiment 1 of the present invention. Referring to FIG. 1, a building is provided with a plurality of (three in this example) elevator apparatuses 1 to 3. The building is also provided with a plurality of landing floors 4 where the elevator apparatuses 1 to 3 can be used. The elevator apparatuses 1 to 3 have cars 5 and elevator doorways 6. The cars 5 can stop at the landing floors 4. The elevator doorways 6 are provided at each of the landing floors 4 so that passengers can get on/off the cars 5 from/to each of the landing floors 4.

An elevator hall 7 is provided at each of the landing floors 4. The elevator doorways 6 of the elevator apparatuses 1 to 3 are provided horizontally apart from one another in the elevator hall 7. Each of the elevator doorways 6 is provided with a pair of elevator doors 8 for opening/closing the elevator doorway 6.

A plurality of (three in this example) hall lanterns 9 for reporting to the elevator hall 7 that one of the elevator doorways 6 which is to be opened subsequently and the arrival of the corresponding one of the cars 5 are provided at each of the landing floors 4. Each of the hall lanterns 9 is provided in the vicinity of a corresponding one of the elevator doorways 6. In this example, that one of the elevator doorways 6 which is to be opened is reported through the lighting of the corresponding one of the hall lanterns 9, and the arrival of the corresponding one of the cars 5 is reported through the blinking of the corresponding one of the hall lanterns 9.

Provided at each of the landing floors 4 is a landing call registration device 10 that can be operated there. In this example, the landing call registration device 10 is installed at a hall doorway through which passengers get into/out of the elevator hall 7. The landing call registration device 10 is provided with a destination floor selector 11 for selecting target floors through the operations by passengers, and an indicator 12 for indicating the target floors selected by the passengers. The target floor selector 11 has a general-purpose selector designed for the selection of target floors by able-bodied persons, and a disabled-accessible selector disposed below the general-purpose selector to help disabled persons such as wheelchair users and the like select target floors. Each of the general-purpose selector and the disabled-accessible selector is provided with a plurality of target floor buttons.

Provided in the car 5 of each of the elevator apparatuses 1 to 3 is an in-car call registration device 13 that can be operated therein. The in-car call registration device 13 is provided with a destination floor selector (not shown) for selecting destination floors of the car 5 through the operation by passengers, and an indicator (not shown) for indicating the current position of the car 5. The destination floor selector is provided with a plurality of destination floor buttons.

Information from the landing call registration device 10 and information from the elevator apparatuses 1 to 3 are transmitted to a control system body 14 for controlling the operations of the elevator apparatuses 1 to 3 comprehensively. The control system body 14 controls the operations of the elevator apparatuses 1 to 3 based on the information from the landing call registration device 10 and the information from the elevator apparatuses 1 to 3.

The control system body 14 has a group supervision/control device 15 for operating and supervising the elevator apparatuses 1 to 3 as a group, and a plurality of (three in this example) individual control devices 16 for controlling the operations of the elevator apparatuses 1 to 3 individually based on information from the group supervision/control device 15.

Figure 2:
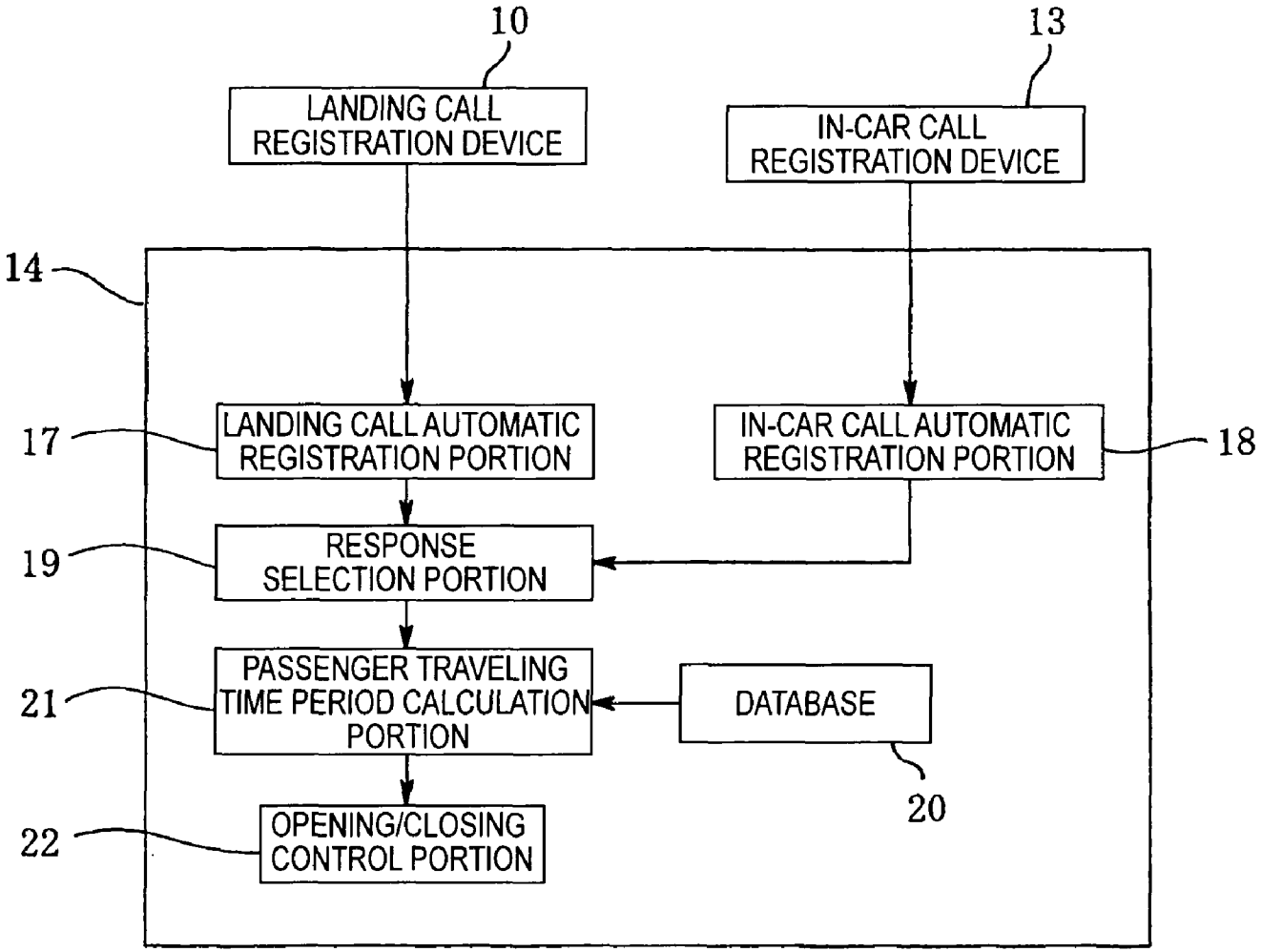
FIG. 2 is a functional block diagram showing the control system for the elevators shown in FIG. 1.

FIG. 2 is a functional block diagram showing the control system for the elevators shown in FIG. 1. Referring to FIG. 2, the control system body 14 has a landing call automatic registration portion 17, an in-car call automatic registration portion 18, a response selection portion 19, a database (storage portion) 20, a passenger traveling time period calculation portion 21, and an opening/closing control portion 22.

The landing call automatic registration portion 17 sets as a car call floor that one of the landing floors 4 whose landing call registration device 10 is operated, based on information from landing call registration devices 10, and automatically makes a car call registration for stopping one of the cars 5 of the elevator apparatuses 1 to 3 at the car call floor.

The in-car call automatic registration portion 18 automatically makes a car call registration for stopping the car 5 at a destination floor selected through the operation of each of in-car call registration devices 13, based on information from the in-car call registration devices 13.

The response selection portion 19 selects as a selected elevator that one of the elevator apparatuses 1 to 3 which responds to a car call registration made by the landing call automatic registration portion 17, based on information from the elevator apparatuses 1 to 3, information from the landing call automatic registration portion 17, and information from the in-car call automatic registration portion 18. That is, the response selection portion 19 calculates as evaluation values waiting time periods at a car call floor which are required until the arrival of the cars 5 of the elevator apparatuses 1 to 3 (performs calculation of the evaluation values), and selects as a selected elevator that one of the elevator apparatuses which has the best evaluation value. In other words, the response selection portion 19 performs calculation of the evaluation values of the elevator apparatuses 1 to 3 to select the selected elevator. The selected elevator is selected based on information on the positions and the speeds of the cars 5 of the elevator apparatuses 1 to 3, information on whether or not each of the cars 5 is fully loaded, information on the number of stops of each of the cars 5 before the arrival thereof at the car call floor, and the like. In this example, the selected elevator is selected by the group supervision/control device 15.

Time periods required for the traveling of passengers from the landing call registration device 10 to the elevator doorways 6 (passenger traveling time periods) are stored in the database 20 in advance.

The passenger traveling time period calculation portion 21 sets as a selected doorway that one of the elevator doorways 6 of the selected elevator which is provided at the car call floor, based on information from the response selection portion 19 and information from the database 20, and calculates a passenger traveling time period required for the traveling of a passenger from the landing call registration device 10 to the selected doorway. The passenger traveling time period is calculated by reading from the database 20 that one of the passenger traveling time periods which corresponds to the selected doorway.

The opening/closing control portion 22 controls the opening/closing operations of the selected doorway based on operational information from the selected elevator and information from the passenger traveling time period calculation portion 21. That is, when the car 5 of the selected elevator stops at the car call floor and a door-opening operation of the selected doorway is completed before the passenger traveling time period calculated by the passenger traveling time period calculation portion 21 elapses after the making of the car call registration by the landing call automatic registration portion 17, the opening/closing control portion 22 holds the selected doorway in a door-open state until the passenger traveling time period elapses. When the door-opening operation of the selected doorway is completed after the lapse of the passenger traveling time period, the opening/closing control portion 22 performs normal opening/closing operations for maintaining the door-open state only for a preset normal door-open time period. The opening/closing operations of the selected doorway are controlled by the corresponding one of the individual control devices 16 based on opening/closing commands from the group supervision/control device 15.

The control system body 14 is constituted by a computer having a central processing unit (CPU), a storage portion (ROM, RAM, and the like), and signal input/output portions. The functions of the landing call automatic registration portion 17, the in-car call automatic registration portion 18, the response selection portion 19, the database 20, the passenger traveling time period calculation portion 21, and the opening/closing control portion 22 are realized by the computer constituting the control system body 14.

That is, programs for realizing the functions of the landing call automatic registration portion 17, the in-car call automatic registration portion 18, the response selection portion 19, the database 20, the passenger traveling time period calculation portion 21, and the opening/closing control portion 22 are stored in the storage portion of the computer. Information on passenger traveling time periods, information on normal door-open time periods, and the like are also stored in the storage portion. The central processing unit performs calculation processings regarding the functions of the control system body 14 based on the programs stored in the storage portion.

Figure 3:
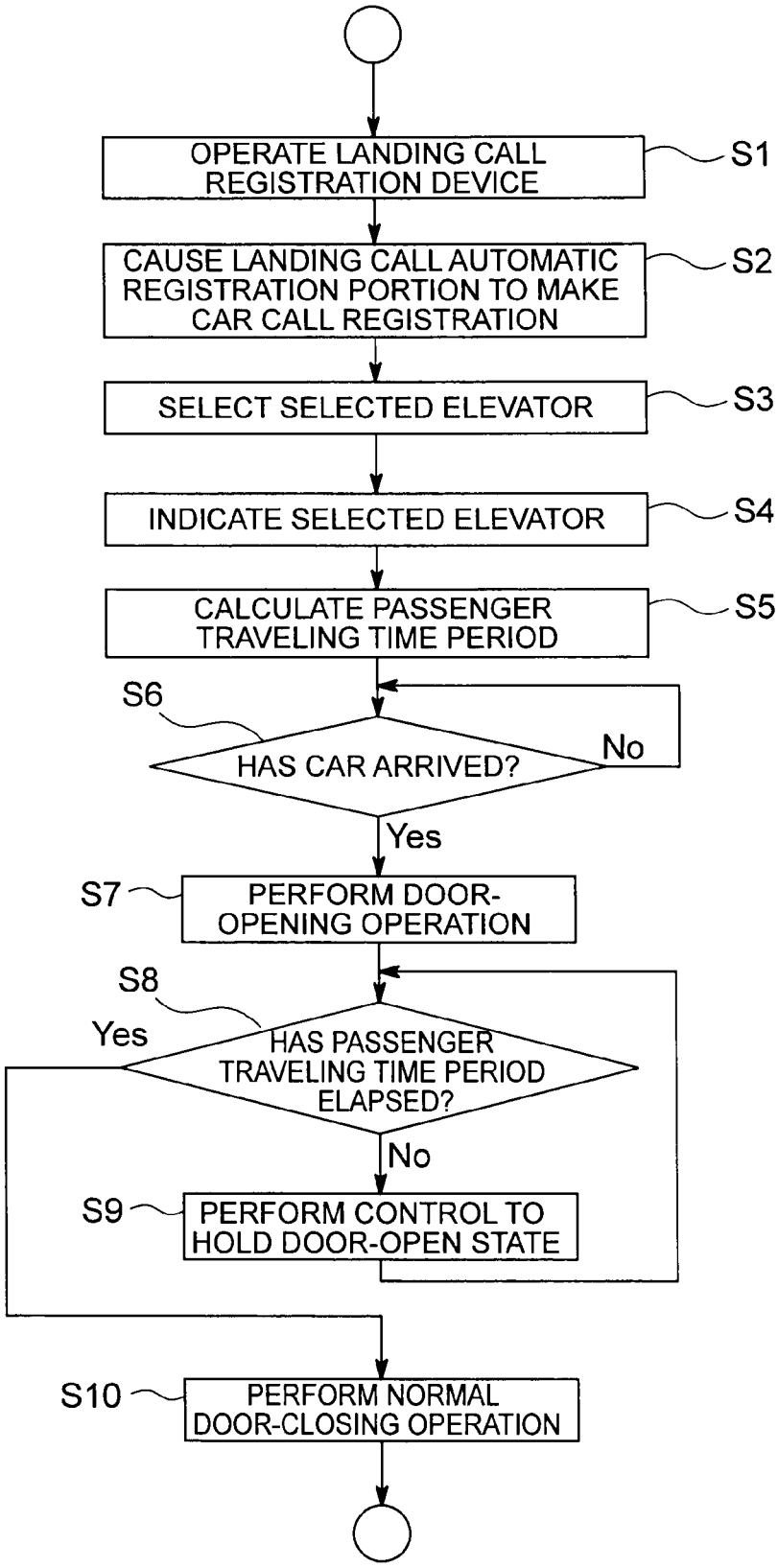
FIG. 3 is a flowchart for explaining processing operations of the control system body of FIG. 2.

Next, an operation thereof will be described. FIG. 3 is a flowchart for explaining processing operations of the control system body 14 of FIG. 2. As shown in FIG. 3, when the landing call registration device 10 is operated (S1), the landing call automatic registration portion 17 makes a car call registration for setting as a car call floor that one of the landing floors 4 where the landing call registration device 10 is installed (S2).

After that, the response selection portion 19 performs calculation of evaluation values of the elevator apparatuses 1 to 3 based on operational information on the elevator apparatuses 1 to 3, information on a car call floor registered by the landing call automatic registration portion 17, and information on a destination floor registered by the in-car call automatic registration portion 18. As a result, that one of the elevator apparatuses 1 to 3 which responds to the car call registration made by the landing call automatic registration portion 17 is selected as the selected elevator (S3). After that, the indicator 12 of the landing call registration device 10 indicates the selected elevator based on information from the response selection portion 19 (S4).

After that, the passenger traveling time period calculation portion 21 calculates a time period required for the traveling of a passenger from the landing call registration device 10 to a selected doorway (the elevator doorway 6 of the selected elevator). The passenger traveling time period is calculated by reading that one of the passenger traveling time periods stored in the database 20 in advance so as to correspond to the respective elevator doorways 6 which corresponds to the selected doorway (S5).

After that, the control system body 14 determines, based on the operational information on the selected elevator, whether or not the car 5 of the selected elevator has arrived at the car call floor (S6). When it is determined that the car 5 has not arrived at the car call floor, it is determined whether or not the car 5 has arrived at the car call floor, until the car 5 arrives at the car call floor.

After that, when it is determined that the car 5 of the selected elevator has arrived at the car call floor, the opening/closing control portion 22 performs control to perform the door-opening operation of the selected doorway (S7). After the door-opening operation of the selected doorway is completed, it is determined whether or not the passenger traveling time period calculated by the passenger traveling time period calculation portion 21 has elapsed after the making of the car call registration by the landing call automatic registration portion 17 (S8).

When it is determined that the passenger traveling time period has not elapsed, the opening/closing control portion 22 performs control to hold the selected doorway in the door-open state until the passenger traveling time period elapses (S9).

When it is determined that the passenger traveling time period has elapsed, the opening/closing control portion 22 performs control to perform a door-closing operation after the lapse of a normal door-open time period, thereby terminating the processing (S10).

The control system for the elevators configured as described above has the passenger traveling time period calculation portion 21 for calculating the time period required for the traveling of a passenger from the landing call registration device 10 to the selected doorway, and the opening/closing control portion 22 for controlling the opening/closing operations of the selected doorway based on information from the passenger traveling time period calculation portion 21. Therefore, even in the case where a long time period is required for the traveling of the passenger because of a long distance from the landing call registration device 10 to the elevator doorway 6, the door-closing operation of the elevator doorway 6 can be prevented from being performed before the passenger arrives at the elevator doorway 6, so the passenger can be prevented from missing the corresponding one of the cars 5. A selected elevator is selected from all the elevator apparatuses 1 to 3, and none of those elevator apparatuses 1 to 3 is excluded from the elevators to be selected. Therefore, the selected elevator can be selected efficiently, so the time period required until each of the cars 5 arrives at the car call floor after the operation of the landing call registration device 10 can be shortened. Accordingly, the waiting time periods of passengers can be shortened.

When the door-opening operation of the selected doorway is completed before the passenger traveling time period elapses after the operation of the landing call registration device 10, the opening/closing control portion 22 holds the selected doorway in the door-open state until the passenger traveling time period elapses. Therefore, passengers can be prevented more reliably from missing the cars 5.

In the foregoing example, one passenger traveling time period is stored in the database 20 for each of the elevator doorways 6. However, a passenger traveling time period for able-bodied persons and a passenger traveling time period for disabled persons may be stored separately for each of the elevator doorways 6. In this case, the passenger traveling time period calculation portion 21 calculates a passenger traveling time period by reading the passenger traveling time period for the able-bodied persons from the database 20 when a car call registration is made through the operation of the general-purpose selector, and by reading the passenger traveling time period for the disabled persons from the database 20 when a car call registration is made through the operation of the disabled-accessible selector. In this manner, even disabled passengers can be prevented from missing the cars 5.

Embodiment 2

In the foregoing example, the door-opening operation of the selected doorway is started immediately after the arrival of the car 5 at the car call floor. However, it is also appropriate to hold the selected doorway in the door-closed state until the passenger traveling time period elapses and perform the door-opening operation of the selected doorway after the passenger traveling time period has elapsed, instead of performing the door-opening operation of the selected doorway immediately after the stoppage of the car 5 at the car call floor.

Figure 4:
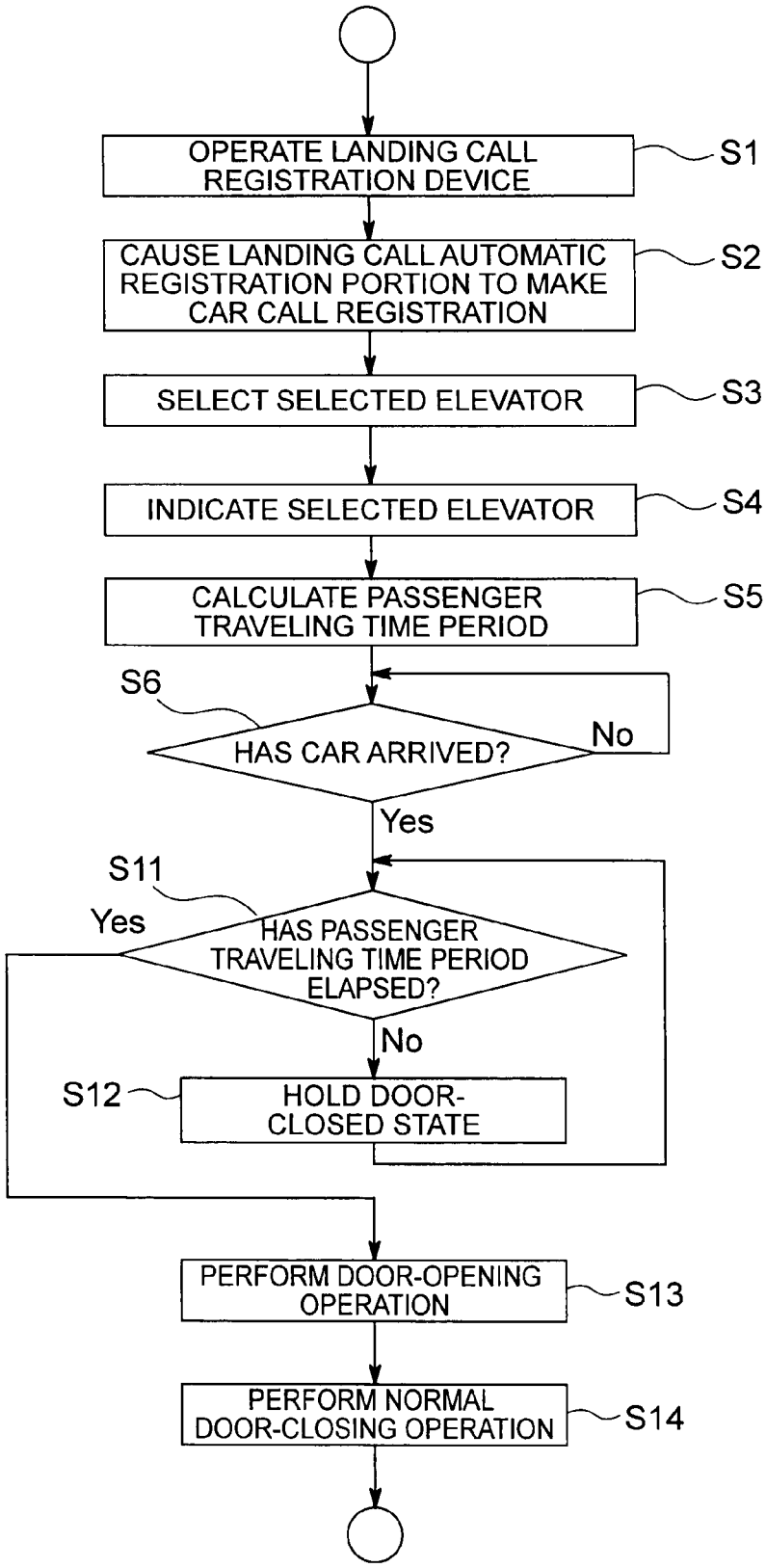
FIG. 4 is a flowchart for explaining the processing operations of a control system for elevators according to Embodiment 2 of the present invention.

FIG. 4 is a flowchart for explaining the processing operations of a control system for elevators according to Embodiment 2 of the present invention. As shown in FIG. 4, the same processing operations as in Embodiment 1 of the present invention are performed until it is determined whether or not the car 5 of the selected elevator has arrived at the car call floor (S6).

When the control system body 14 determines that the car 5 has not arrived at the car call floor, it is determined whether or not the car 5 has arrived at the car call floor, until the car 5 arrives at the car call floor.

After that, when it is determined that the car 5 of the selected elevator has arrived at the car call floor, the control system body 14 determines whether or not the passenger traveling time period has elapsed after the making of the car call registration by the landing call automatic registration portion 17 (S11).

When it is determined that the passenger traveling time period has not elapsed, the opening/closing control portion 22 performs control to hold the selected doorway in the door-closed state (S12). After that, the control system body 14 determines again whether or not the passenger traveling time period has elapsed (S11). When it is determined that the passenger traveling time period has not elapsed, the foregoing operations are repeated. Thus, the selected doorway is held in the door-closed state until the passenger traveling time period elapses.

When it is determined that the passenger traveling time period has elapsed, the opening/closing control portion 22 performs control to perform the door-opening operation of the selected doorway (S13). After the door-opening operation is completed, the door-closing operation is performed to terminate the processing upon the lapse of the normal door-open time period (S14). Embodiment 2 of the present invention is identical to Embodiment 1 of the present invention in other configurational details and other operational details.

In the control system for the elevators configured as described above, when the car 5 arrives at the car call floor before the passenger traveling time period elapses after the making of the car call registration by the landing call automatic registration portion 17, the opening/closing control portion 22 performs control to hold the selected doorway in the door-closed state until the passenger traveling time period elapses. Therefore, a user other than the passenger who has operated the landing call registration device 10 can be prevented from getting on the car 5 of the selected elevator by mistake.

In the foregoing example, the selected doorway is held in the door-closed state until the passenger traveling time period elapses. However, the door-opening operation should not necessarily be started upon the lapse of the passenger traveling time period. Instead, the selected doorway may be held in the door-closed state until an operation starting time instant set on the basis of the lapse of the passenger traveling time period. For instance, if the operation starting time instant is set upon the lapse of a time period shorter than the passenger traveling time period by a predetermined time period, the door-opening operation of the selected doorway can be performed immediately before the passenger arrives at the selected doorway, so the passenger is allowed to get on the car 5 of the selected elevator smoothly. Thus, the user-friendliness of the elevator apparatuses 1 to 3 can be enhanced.

Embodiment 3

Figure 5:
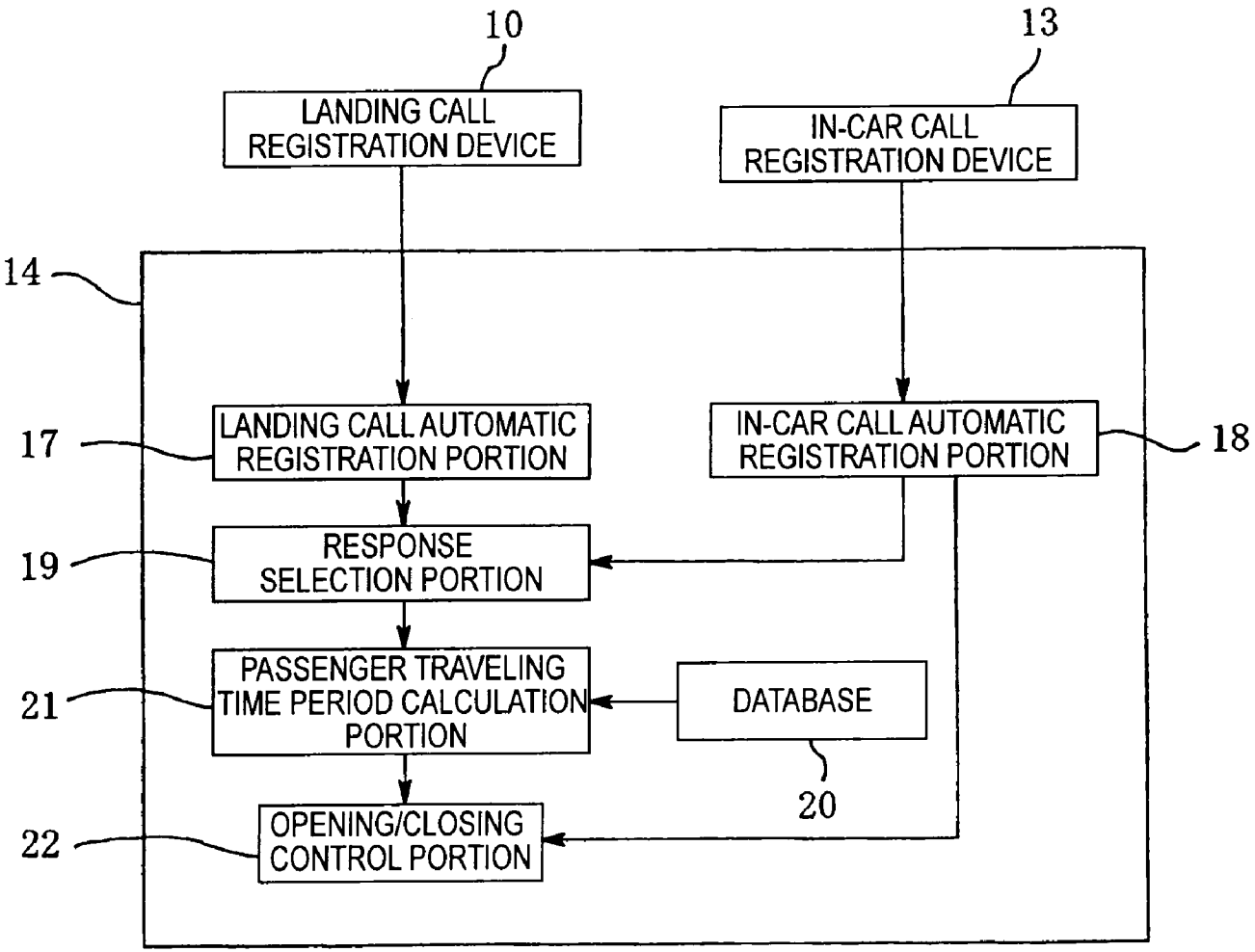
FIG. 5 is a functional block diagram showing a control system for elevators according to Embodiment 3 of the present invention.

FIG. 5 is a functional block diagram showing a control system for elevators according to Embodiment 3 of the present invention. Referring to FIG. 5, information from the in-car call automatic registration portion 18 is transmitted to the opening/closing control portion 22 as well as the response selection portion 19. The opening/closing control portion 22 controls the opening/closing operations of a selected doorway based on information from a selected elevator, information from the passenger traveling time period calculation portion 21, and information from the in-car call automatic registration portion 18.

That is, when there is a car call registration made by the in-car call automatic registration portion 18, the opening/closing control portion 22 performs normal opening/closing operations of the selected doorway which are irrelevant to the passenger traveling time period. When there is no car call registration made by the in-car call automatic registration portion 18 and the car 5 stops at a car call floor before the passenger traveling time period elapses after the making of a car call registration by the landing call automatic registration portion 17, the opening/closing control portion 22 performs the opening/closing operations based on the passenger traveling time period.

The opening/closing operations based on the passenger traveling time period are the same as in the foregoing Embodiment 2 of the present invention. That is, the selected doorway is held in the door-closed state until the operation starting time instant set on the basis of the lapse of the passenger traveling time period, and the door-opening operation of the selected doorway is started after the operation starting time instant. Embodiment 3 of the present invention is identical to Embodiment 2 of the present invention in other configurational details.

Figure 6:
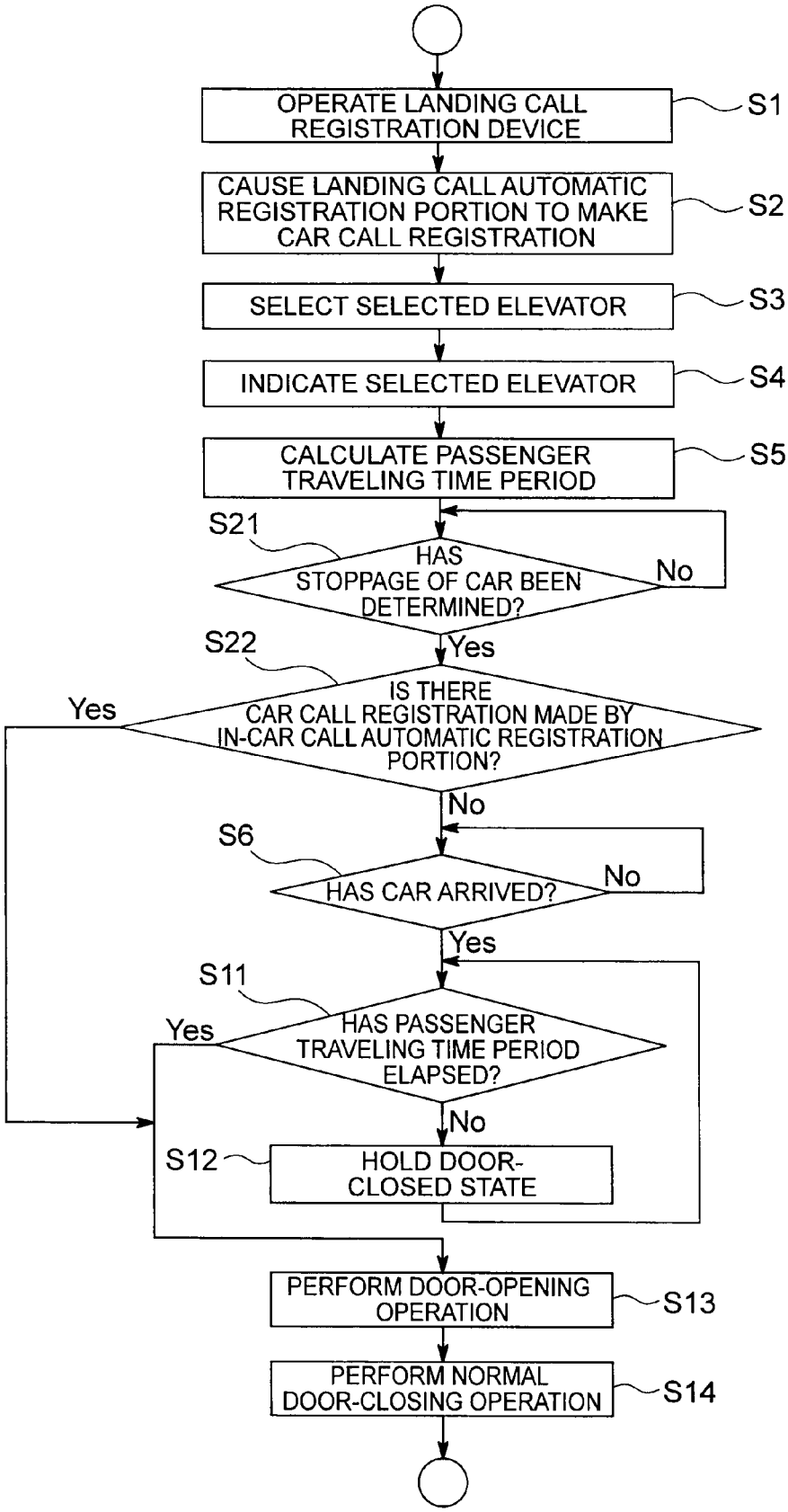
FIG. 6 is a flowchart for explaining the processing operations of the control system for the elevators shown in FIG. 5.

FIG. 6 is a flowchart for explaining the processing operations of the control system for the elevators shown in FIG. 5. As shown in FIG. 6, the same operations (S1 to S5) as in Embodiment 2 of the present invention are performed until the passenger traveling time period calculation portion 21 calculates a passenger traveling time period after the start of the processing operations.

After the passenger traveling time period is calculated, the control system body 14 determines whether or not deceleration of the car 5 for stopping the car 5 at a car call floor has been started (stoppage of the car 5 at the car call floor has been determined) (S21). When it is determined that deceleration of the car 5 has not been started, it is repeatedly determined whether or not deceleration of the car 5 has been started, until deceleration of the car 5 is started.

When it is determined that deceleration of the car 5 has been started, the control system body 14 determines whether or not a car call registration has been made by the in-car call automatic registration portion 18 (S22). When it is determined that the car call registration has been made by the in-car call automatic registration portion 18, the opening/closing control portion 22 performs control to cause a selected doorway to perform normal opening/closing operations (S13, S14), thereby terminating the processing.

When it is determined that no car call registration has been made by the in-car call automatic registration portion 18, the opening/closing control portion 22 assumes that there is no passenger in the car 5 of the selected elevator. After that, the control system body 14 determines, based on operational information on the selected elevator, whether or not the car 5 of the selected elevator has arrived at the car call floor (S6). The subsequent operations are the same as in Embodiment 2 of the present invention.

As described above, when there is no car call registration made by the in-car call automatic registration portion 18 and the car 5 stops at the car call floor before the passenger traveling time period elapses after the operation of the landing call registration device 10, the opening/closing control portion 22 holds the selected doorway in the door-closed state until the operation starting time instant set on the basis of the lapse of the passenger traveling time period, and starts the door-opening operation of the selected doorway after the operation starting time instant. Therefore, the start of the door-opening operation of the selected doorway can be retarded only when there is no passenger in the car 5 of the selected elevator. Accordingly, the door-opening operation of the selected doorway can be prevented from being retarded when there is a passenger in the car 5 of the selected elevator, so the operating efficiency of the elevators can be enhanced.

In the foregoing example, the opening/closing operations based on the passenger traveling time period are the same as in Embodiment 2 of the present invention. However, the same opening/closing operations as in Embodiment 1 of the present invention may be performed to hold the selected doorway in the door-open state until the passenger traveling time period elapses.

Embodiment 4

In each of the foregoing examples, the passenger traveling time period corresponding to each of the elevator doorways 6 does not differ depending on the degree of crowdedness of a car call floor. However, the passenger traveling time period may differ depending on the degree of crowdedness of the car call floor.

That is, time zone information including information on a peak time zone in which the respective landing floors 4 are crowded with passengers and information on an off-peak time zone in which the landing floors 4 are uncrowded, and passenger traveling time period information including information on passenger traveling time periods corresponding to the peak time zone and information on passenger traveling time periods corresponding to the off-peak time zone are stored in the database 20. The passenger traveling time periods included in the passenger traveling time period information are so set as to correspond to each of the elevator doorways 6.

The passenger traveling time period calculation portion 21 selects either the passenger traveling time periods in the peak time zone or the passenger traveling time periods in the off-peak time zone based on information at the time of the making of a car call registration by the landing call automatic registration portion 17, and reads that one of the selected passenger traveling time periods which corresponds to a selected elevator. In this manner, the passenger traveling time period calculation portion 21 calculates the passenger traveling time period corresponding to the selected elevator. Embodiment 4 of the present invention is identical to Embodiment 1 of the present invention in other configurational details.

Next, an operation thereof will be described. Processing operations in Embodiment 4 of the present invention are the same as in Embodiment 1 of the present invention except the processing operations in calculating the passenger traveling time period. Therefore, only the processing operations in calculating the passenger traveling time period will be described.

Figure 7:
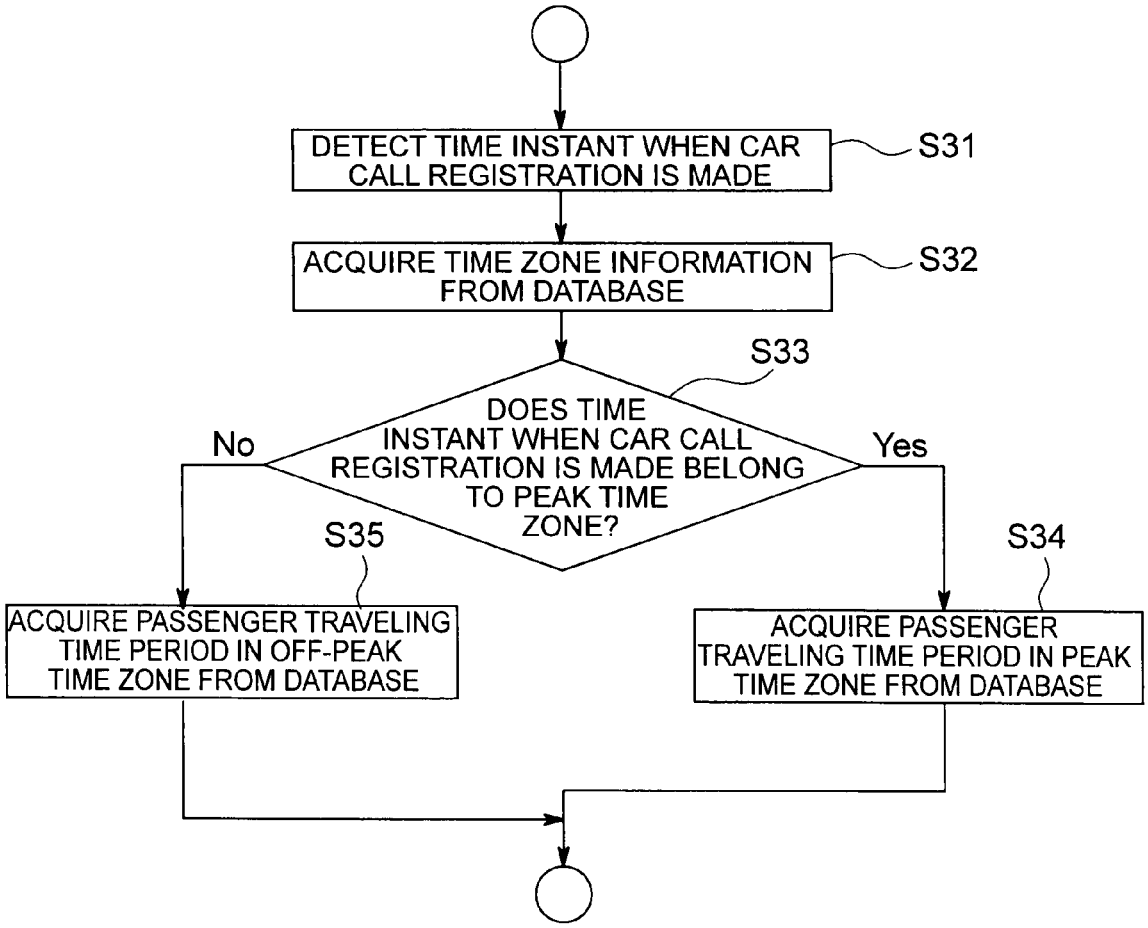
FIG. 7 is a flowchart for explaining the processing operations in calculating the passenger traveling time period in a control system for elevators according to Embodiment 4 of the present invention.

FIG. 7 is a flowchart for explaining the processing operations in calculating the passenger traveling time period in a control system for elevators according to Embodiment 4 of the present invention. As shown in FIG. 7, after detecting a time instant when the landing call automatic registration portion 17 makes a car call registration (S31), the passenger traveling time period calculation portion 21 reads the time zone information from the database (S32).

After that, the passenger traveling time period calculation portion 21 compares the detected time instant with the time zone information. Thus, the passenger traveling time period calculation portion 21 determines whether or not the time instant when the landing call automatic registration portion 17 makes the car call registration is within the peak time zone (S33).

When it is determined that the time instant when the car call registration is made is within the peak time zone, the passenger traveling time period calculation portion 21 reads from the database 20 that one of the passenger traveling time periods which corresponds to the peak time zone and a selected elevator (S34). In this manner, the passenger traveling time period corresponding to a selected doorway is calculated.

When it is determined that the time instant when the car call registration is made is not within the peak time zone, the passenger traveling time period calculation portion 21 reads from the database 20 that one of the passenger traveling time periods which corresponds to the off-peak time zone and the selected elevator (S35). In this manner, the passenger traveling time period corresponding to the selected doorway is calculated. The subsequent operations are the same as in Embodiment 1 of the present invention.

In the control system for the elevators configured as described above, the passenger traveling time periods in the peak time zone and the off-peak time zone are set in the database 20 in advance, and it is determined to which one of the time zones the time instant when the landing call automatic registration portion 17 makes the car call registration belongs, so the passenger traveling time period corresponding to the degree of crowdedness of the car call floor with passengers is calculated. Therefore, the passenger traveling time period at the car call floor can be calculated more reliably with a simple configuration, so the passengers can further be prevented from missing the respective cars 5.

Embodiment 5

In the foregoing example, a determination on the degree of crowdedness at the car call floor is made according to each of the time zones. However, the determination on the degree of crowdedness at the car call floor may be made according to the number of car call registrations made by the landing call automatic registration portion 17.

That is, in Embodiment 5 of the present invention, the passenger traveling time period calculation portion 21 detects the number of car call registrations made by the landing call automatic registration portion 17 per unit time (e.g., per minute), and determines, based on the detected number of the car call registrations, whether or not the car call floor is crowded. That is, when the number of the car call registrations made by the landing call automatic registration portion 17 per unit time is larger than a preset reference number, the passenger traveling time period calculation portion 21 determines that the car call floor is crowded. When the number of the car call registrations is equal to or smaller than the reference number, the passenger traveling time period calculation portion 21 determines that the car call floor is uncrowded.

Passenger traveling time periods in a crowded state and passenger traveling time periods in an uncrowded state are so stored in the database 20 in advance as to correspond to the respective elevator doorways 6. The passenger traveling time period calculation portion 21 selects, based on a result of the determination made on the crowdedness of the car call floor, either the passenger traveling time periods in the crowded state or the passenger traveling time periods in the uncrowded state, and reads that one of the selected passenger traveling time periods which corresponds to a selected elevator. In this manner, the passenger traveling time period calculation portion 21 calculates the passenger traveling time period corresponding to the selected elevator. Embodiment 5 of the present invention is identical to Embodiment 1 of the present invention in other configurational details.

Next, an operation thereof will be described. Processing operations in Embodiment 5 of the present invention are the same as in Embodiment 1 of the present invention except the processing operations in calculating the passenger traveling time period. Therefore, only the processing operations in calculating the passenger traveling time period will be described.

Figure 8:
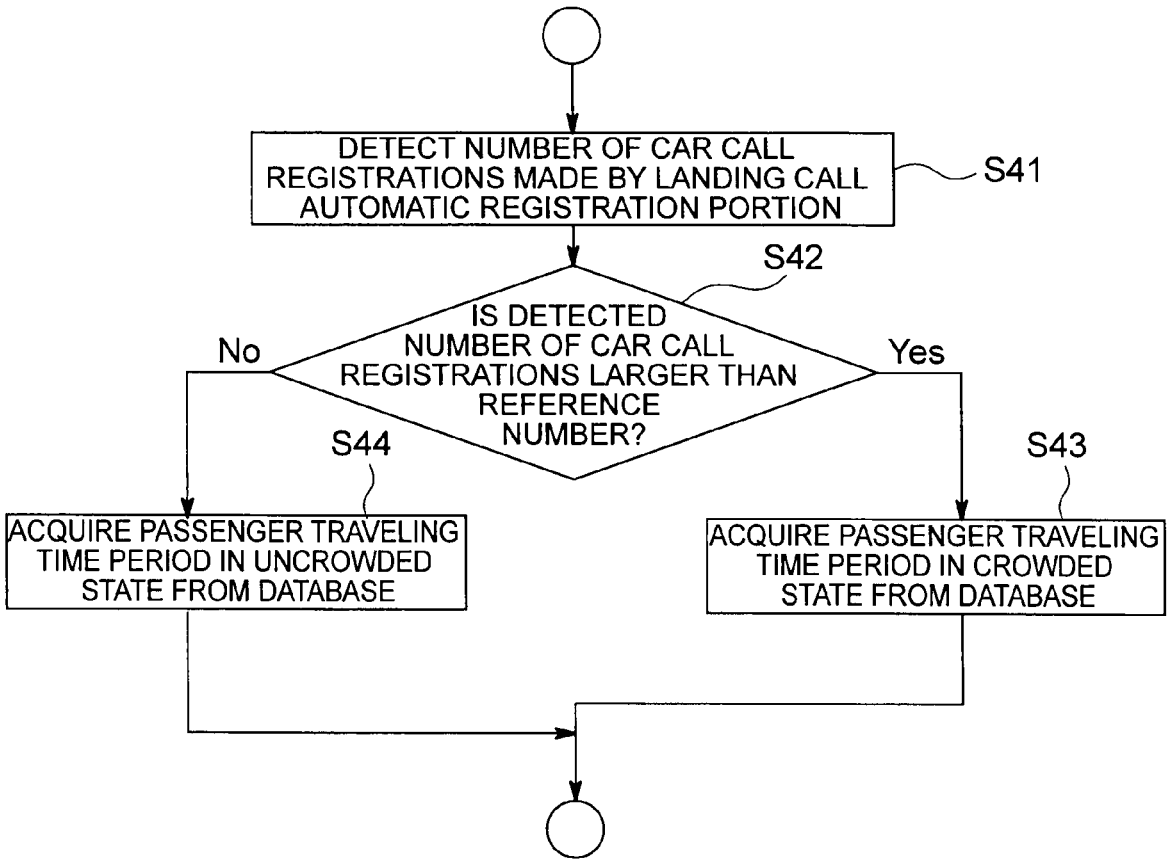
FIG. 8 is a flowchart for explaining the processing operations in calculating the passenger traveling time period in a control system for elevators according to Embodiment 5 of the present invention.

FIG. 8 is a flowchart for explaining the processing operations in calculating the passenger traveling time period in a control system for elevators according to Embodiment 5 of the present invention. As shown in FIG. 8, in calculating the passenger traveling time period, the passenger traveling time period calculation portion 21 detects the number of car call registrations made by the landing call automatic registration portion 17 per unit time (S41). After that, the passenger traveling time period calculation portion 21 determines whether or not the detected number of the car call registrations is larger than a reference number (S42).

When the number of the car call registrations is larger than the reference number, the car call floor is considered to be crowded, so the passenger traveling time period calculation portion 21 reads the passenger traveling time periods in the crowded state from the database 20 (S43).

When the number of the car call registrations is equal to or smaller than the reference number, the car call floor is considered to be uncrowded, so the passenger traveling time period calculation portion 21 reads the passenger traveling time periods in the uncrowded state from the database 20 (S44).

In this manner, after the passenger traveling time period corresponding to the selected doorway has been calculated, the processing operations are performed in the same manner as in Embodiment 1 of the present invention.

As described above, the passenger traveling time period calculation portion 21 determines, based on the number of the car call registrations made by the landing call automatic registration portion 17, whether or not the car call floor is crowded, and calculates the passenger traveling time period based on the result of the determination. Therefore, even in the case where the number of passengers increases temporarily, for example, when a group of visitors use the elevators, the passenger traveling time period at the car call floor can be calculated more reliably with a simple configuration, so the passengers can further be prevented from missing the respective cars 5.

Embodiment 6

Figure 9:
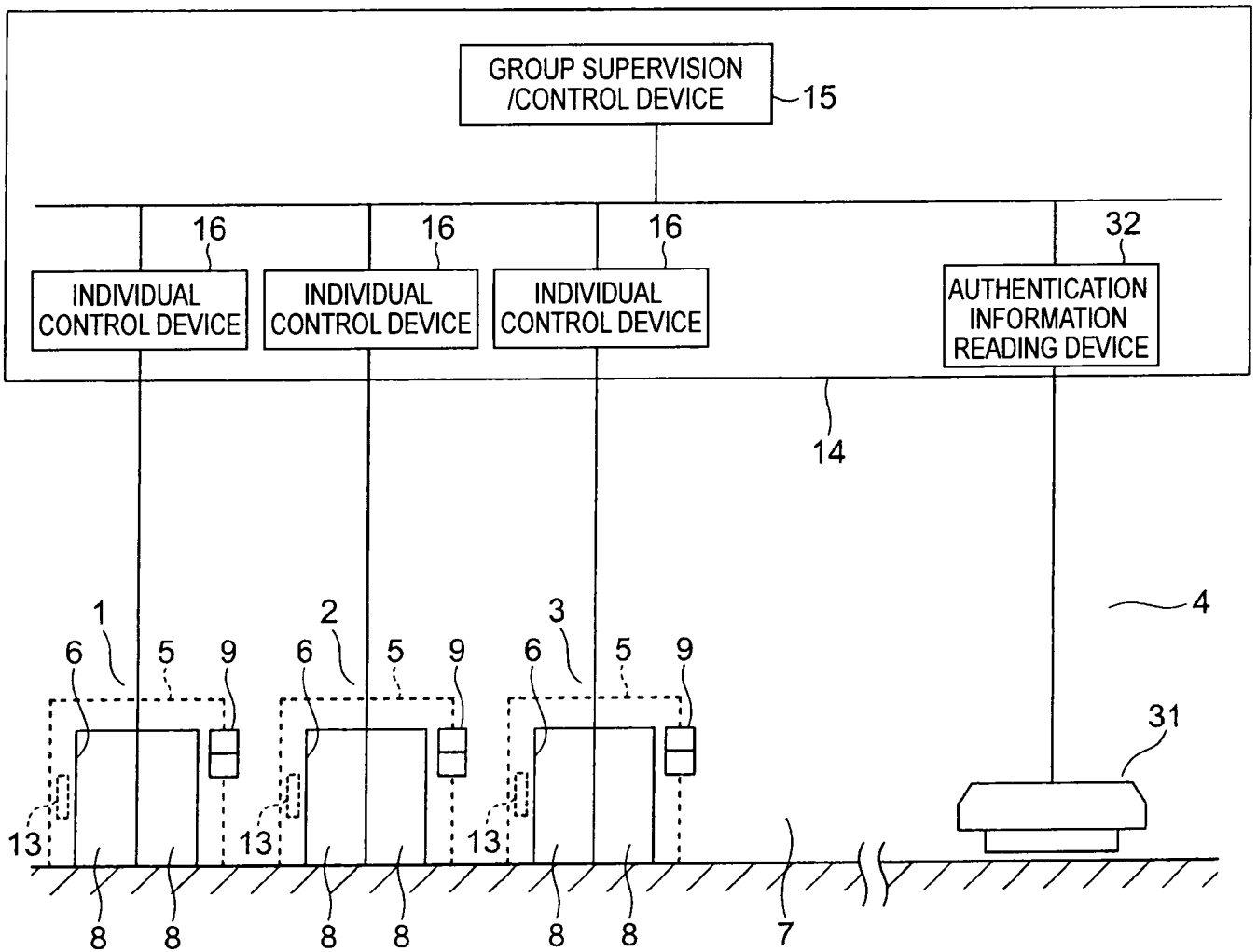
FIG. 9 is a schematic diagram showing a control system for elevators according to Embodiment 6 of the present invention.
Figure 10:
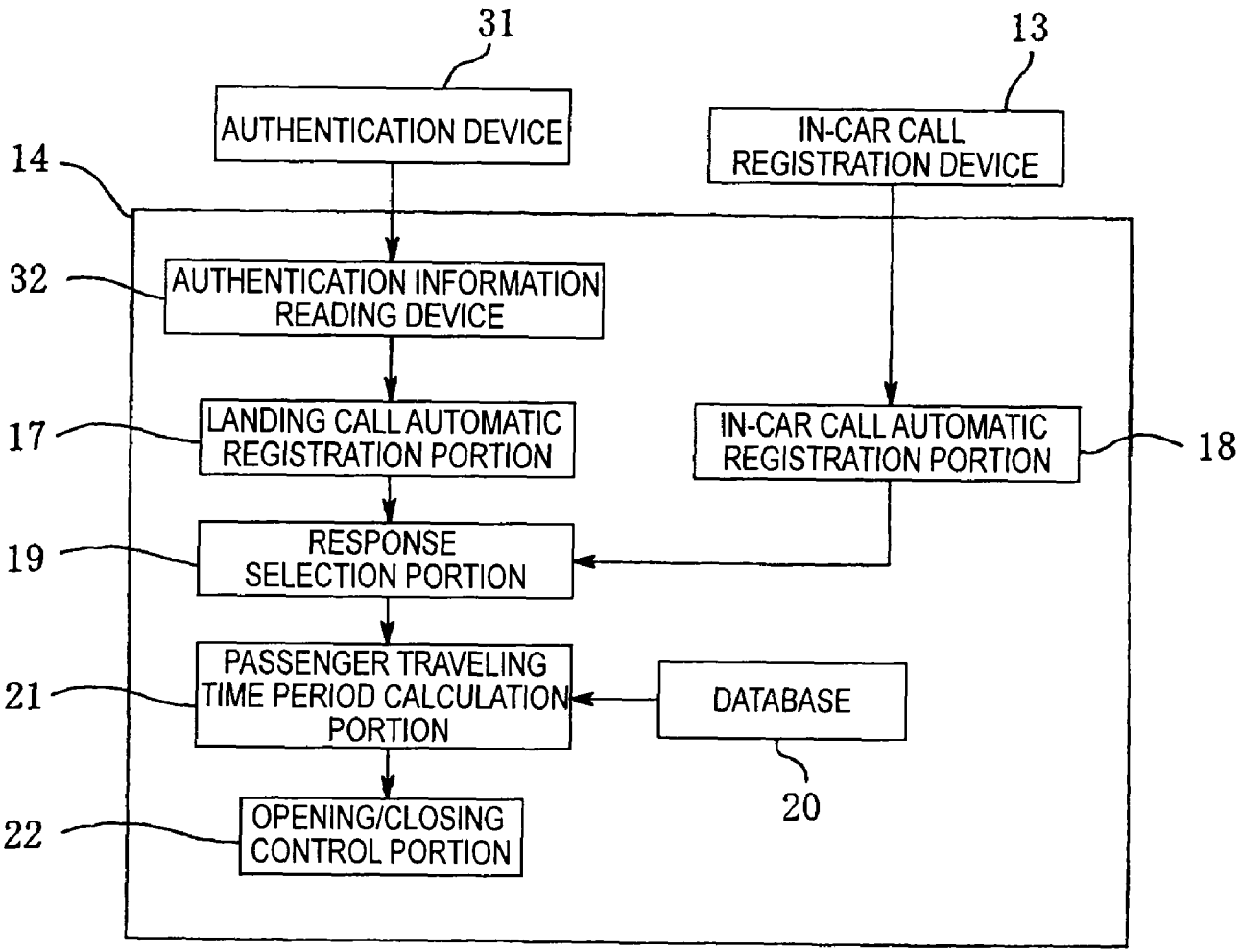
FIG. 10 is a functional block diagram showing the control system for the elevators shown in FIG. 9.

FIG. 9 is a schematic diagram showing a control system for elevators according to Embodiment 6 of the present invention. FIG. 10 is a functional block diagram showing the control system for the elevators shown in FIG. 9. Referring to FIGS. 9 and 10, an authentication device 31, which can acquire personal information on passengers stored in, for example, contact-type magnetic cards, non-contact-type IC cards, non-contact tag components or the like so as to authenticate individuals based on the acquired personal information, is installed at each of the landing floors 4 as a landing call registration device.

The hall doorway of the elevator hall 7 is provided with a security gate for allowing a passenger to enter the elevator hall 7 only when the personal information on the passenger is authenticated by the authentication device 31. The hall doorway may be provided with a door that is usually locked but temporarily unlocked through an authentication made by the authentication device 31. Alternatively, the hall doorway may be provided with a door that automatically opens the hall doorway only when an authentication is made by the authentication device 31.

The control system body 14 further has an authentication information reading device 32 for analyzing personal information acquired by the authentication device 31. The personal information contains detailed information on, for example, passenger traveling time periods corresponding to the respective elevator doorways 6, target floors, car call floors, and the like. The authentication information reading device 32 analyzes the personal information to detect the above-mentioned detailed information.

Information from the authentication information reading device 32 is transmitted to the landing call automatic registration portion 17. The landing call automatic registration portion 17 makes a car call registration only when a passenger is authenticated by the authentication device 31.

The passenger traveling time period calculation portion 21 calculates a passenger traveling time period corresponding to the personal information authenticated by the authentication device 31, based on the information from the authentication information reading device 32. That is, the passenger traveling time period calculation portion 21 reads the information on the passenger traveling time periods from the detailed information analyzed by the authentication information reading device 32, thereby calculating a passenger traveling time period corresponding to the personal information. Embodiment 6 of the present invention is identical to Embodiment 1 of the present invention in other configurational details.

In the control system for the elevators configured as described above, the landing call automatic registration portion 17 makes a car call registration only when a passenger is authenticated by the authentication device 31. Therefore, a car call registration can be prevented from being made by an outsider, so an improvement in security effect can be achieved.

The passenger traveling time period calculation portion 21 calculates the passenger traveling time period corresponding to the personal information authenticated by the authentication device 31, so the passenger traveling time period can be set elaborately for each of the passengers. As a result, the passengers can be prevented more reliably from missing the respective cars 5.

In the foregoing example, the information on the passenger traveling time periods is included in the personal information. However, information such as gender, age, and the like may be included in the personal information, and information on passenger traveling time periods corresponding to gender, age, and the like may be stored in the database 20. In this case, the passenger traveling time period calculation portion 21 reads from the database 20 that one of the passenger traveling time periods which corresponds to the personal information authenticated by the authentication device 31.

In each of the foregoing embodiments of the present invention, the present invention is applied to the control system for the elevators which controls the plurality of the elevator apparatuses 1 to 3 comprehensively. However, the present invention may be applied to a control system for an elevator which controls a single elevator apparatus. In this case, the control system body 14 does not have the group supervision/control device 15. The control system body 14 is not required to select a selected elevator, so information from the landing call automatic registration portion 17 is directly input to the passenger traveling time period calculation portion 21.

In the control system for the elevator which controls the single elevator apparatus as described above, even when the door-opening operation of each of the elevator doorways 6 is completed before a passenger traveling time period elapses after the making of a car call registration by the landing call automatic registration portion 17, each of the elevator doorways 6 is held in the door-open state until the passenger traveling time period elapses. Therefore, the door-closing operation of each of the elevator doorways 6 can be prevented from being performed before a passenger arrives at the elevator doorway 6, so the passenger can be prevented from missing the car 5.

The invention claimed is:

1. A control system for elevators for controlling operations of a plurality of elevator apparatuses, which have cars that can stop at a common landing floor and elevator doorways provided at the landing floor for allowing passengers to get on/off the cars stopped at the landing floor from/to the landing floor, the control system being characterized by comprising:

a landing call registration device provided at the landing floor to be operable at the landing floor;

a landing call automatic registration portion for setting as a car call floor the landing floor where the landing call registration device is operated, and making a car call registration for stopping any one of the cars at the car call floor;

a response selection portion for selecting as a selected elevator that one of the elevator apparatuses which responds to the car call registration, based on information from the elevator apparatuses and information from the landing call automatic registration portion;

a passenger traveling time period calculation portion for setting as a selected doorway that one of the elevator doorways of the selected elevator, which is provided at the car call floor, based on information from the response selection portion, and calculating a passenger traveling time period required for traveling of passengers from the landing call registration device to the selected doorway; and an opening/closing control portion for controlling opening/closing operations of the selected doorway based on information from the selected elevator and information from the passenger traveling time period calculation portion.

2. A control system for elevators for controlling a single elevator apparatus, which has a car that can stop at a landing floor and an elevator doorway provided at the landing floor for allowing passengers to get on/off the car stopped at the landing floor from/to the landing floor, the control system being characterized by comprising:

a landing call registration device provided at the landing floor to be operable at the landing floor;

a landing call automatic registration portion for setting as a car call floor the landing floor where the landing call registration device is operated, and making a car call registration for stopping the car at the car call floor;

a passenger traveling time period calculation portion for setting as a selected doorway that the elevator doorway which is provided at the car call floor, and calculating a passenger traveling time period required for traveling of passengers from the landing call registration device to the selected doorway; and an opening/closing control portion for controlling opening/closing operations of the selected doorway based on information from the elevator apparatus and information from the passenger traveling time period calculation portion.

3. A control system for elevators according to claim 1 or 2, characterized in that the passenger traveling time period calculation portion calculates the passenger traveling time period corresponding to a degree of crowdedness of the car call floor with the passengers.

4. A control system for elevators according to claim 1 or 2, characterized in that the opening/closing control portion holds the selected doorway in a door-open state until the passenger traveling time period elapses, when the car stops at the car call floor and a door-opening operation of the selected doorway is completed before the passenger traveling time period elapses after making of a car call registration by the landing call automatic registration portion.

5. A control system for elevators according to claim 1 or 2, characterized in that the opening/closing control portion holds the selected doorway in a door-closed state until an operation starting time instant set on a basis of a lapse of the passenger traveling time period, when the car stops at the car call floor before the passenger traveling time period elapses after making of a car call registration by the landing call automatic registration portion.

6. A control system for elevators according to claim 1 or 2, characterized in that:

the landing call registration device is an authentication device capable of acquiring personal information on the passengers to conduct personal authentication based on the personal information; and the landing call automatic registration portion makes the car call registration when each of the passengers is authenticated through the personal authentication.

7. A control system for elevators according to claim 6, characterized in that the passenger traveling time period calculation portion calculates the passenger traveling time period corresponding to the personal information on each of the passengers authenticated by the authentication device.

* * * * *